United States Patent [19]

Schiel

[11] 4,379,369

[45] Apr. 12, 1983

[54] DRYING CYLINDER FOR MACHINES FOR MAKING PAPER AND A METHOD FOR MAKING THE DRYING CYLINDER

[75] Inventor: Christian Schiel, Heidenheim, Fed. Rep. of Germany

[73] Assignee: J. M. Voith GmbH, Heidenheim, Fed. Rep. of Germany

[21] Appl. No.: 274,715

[22] Filed: Jun. 18, 1981

[51] Int. Cl.[3] ..... F26B 13/18

[52] U.S. Cl. ..... 34/110; 34/119; 34/124; 165/136

[58] Field of Search ..... 34/119, 124, 108, 110; 165/135, 136

[56] References Cited

U.S. PATENT DOCUMENTS 3,065,552 11/1962 Skinner ..... 34/124

4,313,267 2/1982 Alexy ..... 34/110

*Primary Examiner*—Larry I. Schwartz

*Attorney, Agent, or Firm*—Albert L. Jeffers; John F. Hoffman

[57] ABSTRACT

A steam heated drying cylinder for machines for making paper comprising a cylindrical shell having inner surfaces thereon. The cylindrical shell includes a center region of substantially uniform thickness, end flanges extending radially inwardly of the center region, and transition regions between the center region and end flanges. The transition regions have inner surfaces that taper radially outwardly from the end flanges toward the center region. An insulation layer is disposed on the inner surfaces of the transition regions so as to provide substantially uniform drying along the width of the paper being made.

6 Claims, 3 Drawing Figures

DRYING CYLINDER FOR MACHINES FOR MAKING PAPER AND A METHOD FOR MAKING THE DRYING CYLINDER

The invention relates to a steam heated drying cylinder having a cylinder jacket center with end flanges shaped thereon, for example, by tip-stretching.

Referring in particular to rapidly operated paper machines by which the paper is dried on rotating, steam heated drying cylinders, an undesirable effect arises in that the paper dries faster along its edges than in its center. This causes the edges to shrink more rapidly than the remainder of the paper thereby creating folds in the paper or presenting the possibility that the edges will tear off. Furthermore, the overdried edges are of poorer quality than the remainder of the paper and will cause further problems at subsequent smoothing and processing steps. Earlier attempts to rectify this problem consisted of spraying water on the paper, but only insignificant improvements were noted, while increasing energy costs of the drying process.

The objects of the invention therefore are to prevent the overdrying of the paper's edges, caused in part by more intense air circulation about the edge portions of the cylinder, by simple means; to improve the quality of the paper produced; to reduce the amount of scrap paper resulting from overdrying; and to decrease the energy requirements of the machine.

To aid in the accomplishment of the above objectives, the cylinder required for drying paper of a given width should be as small as possible. This would result in the cylinders becoming less expensive, while further allowing the ropes, which lead the paper, to be placed closer to the edge of the paper thereby providing for easier, faster, and more reliable startup of the leading after interruptions in operation.

The above problem was solved by depositing a preferably adhering layer of insulation on the inner end faces of the flanges, or, in other words, on the transition region between the cylinder portion of the jacket and the cylindrical portion of the flanges. The inventor has visualized the problem in the following manner: the effect of air circulation at the edge regions is known and is valuable. However, the circulation has two significant, negative influences. First, heat may flow axially in the cylinder jacket of the drying cylinder from the hotter edge, which does not release any heat, towards the paper edge which dissipates heat upon evaporation of the moisture contained therein. Second, a ring of condensate on the cylindrical part of the drying cylinder has a significant insulating effect which is lacking in the inner end faces of the flanges because these regions extend beyond the condensate ring. The thermal resistance in the portion of the cylinder jacket extending beyond the condensate film, but short of the full thickness of the end flange, is low because the thermal resistance of the condensate is lacking and the existing wall thickness is smaller than in the end flange regions.

It is not necessary to apply the insulation layer onto the conical or rounded transition regions between the cylinder jacket center and end flanges of all the drying cylinders. A tangible improvement results if the insulating layer is applied only to the transition regions of the drying cylinder. In particular, if the insulating layer is applied rather thick it will be sufficient to insulate only one-third or less of the drying cylinders in the transition regions in order to compensate for the overdrying of the paper edges.

Because the paper shrinks in width during the drying, the position of the paper's edge with respect to the drying cylinder's width varies. To compensate for this, the insulation layer should be extended onto the cylindrical portion of the cylinder at the beginning of the drying process or onto the inner surface of the cylinder jacket center at the end of the drying process. Once the correct material has been selected for the insulation, it will have a distinct effect upon the insulating properties of the condensate because the coefficient of thermal conductivity of the insulating material is only a fraction of the coefficient for the condensate.

An insulation material of 0.5 mm thickness and having an appropriate coefficient of thermal conductivity can provide better insulation than a condensate having a thickness of 2.0 mm.

The cost of utilizing the invention may be reduced by applying the insulation layer to only a few drying cylinders. However, to compensate for the overdrying of those drying cylinders without insulation, a thickness of 5.0 mm is required on the insulated drying cylinders. A thickness greater than 5.0 mm yields no significant improvement in performance.

If greater insulating thicknesses are desired, the insulating material should be formed into a cover or mat, and then adhesively applied to the desired surface by a gluing, bonding, or vulcanizing process.

In a preferred embodiment, the adhering, insulating layer is applied as a paste which thereafter hardens. Further applications may be made by employing self-hardening, polycomponent plastic mixtures, or solids which by the addition of a solvent become soft and then hardened upon solvent evaporation. A technique of depositing the adhering, insulating layer as a paste is particularly desirable when dealing with thinner layer thicknesses, or with layers which will not only cover the transition region between the cylinder jacket center and the end flanges, but also extend onto the inner surfaces thereof.

In the broader aspects of this invention there is provided a steam heated drying cylinder for machines for making paper comprising a cylinder jacket which has end flanges, transition regions having inner surfaces thereon for connecting the cylinder jacket center to the end flanges, and an insulation layer on the inner surfaces of the transition regions.

BRIEF DESCRIPTION OF THE DRAWINGS

The above-mentioned and other features and objects of this invention and the manner of attaining them will become more apparent and the invention itself will be better understood by reference to the following description of an embodiment of the invention taken in conjunction with the accompanying drawings, wherein.

DESCRIPTION OF A SPECIFIC EMBODIMENT

Figure 1:
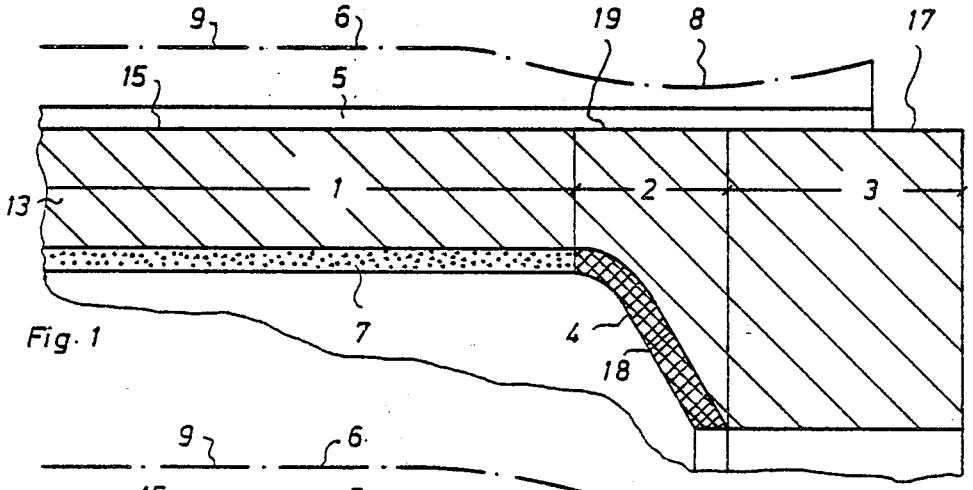
FIG. 1 is a partial, longitudinal section of an end of a specific embodiment of the invention depicting the paper extending onto the outer surface of an end flange.

In the three figures there are shown the drying cylinder jacket 13, cylinder jacket center region 1, transition region 2, and end flange 3. Also depicted are insulating layer 4, paper 5, condensate ring 7 on the inner surface 14 of cylinder jacket center region 1 and curve 6 representing moisture content inside paper 5.

In all three figures, the overdrying in the edge region of paper 5 is represented by lower curve portion 8 of curve 6.

In FIG. 1, paper 5 extends onto outer surface 17 of end flange 3. Overdrying occurs primarily in that portion of paper 5 covering outer surface 19 of transition region 2. At the edge of paper 5, the moisture content may increase slightly as shown by curve 6. This increase in moisture content is a function of the thickness of end flange 3 and the axial radiation of heat toward end flange 3.

Uniform drying across the width of paper 5 is accomplished by applying insulation layer 4 to inner surface 18 of transition region 2. This uniformity of drying is visually depicted by curve 6 becoming a straight, horizontal line 9.

Figure 2:
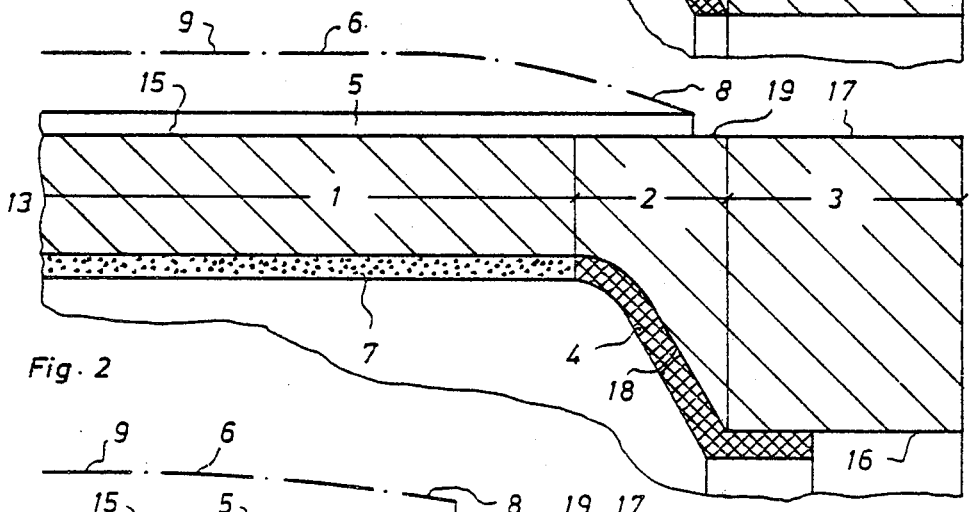
FIG. 2 is a partial, longitudinal section of an end of a specific embodiment of the invention depicting the paper terminating on the outer surface of a transition region.

Referring to FIG. 2, paper 5 is shown with an intermediate width extending onto outer surface 19 of transition region 2. Curve 6 shows the overdrying in the edge region of paper 5 is rather high. This overdrying may be substantially eliminated by applying insulating layer 4 onto inner surface 18 of transition region 2 and partially onto inner surface 16 of end flange 3.

Figure 3:
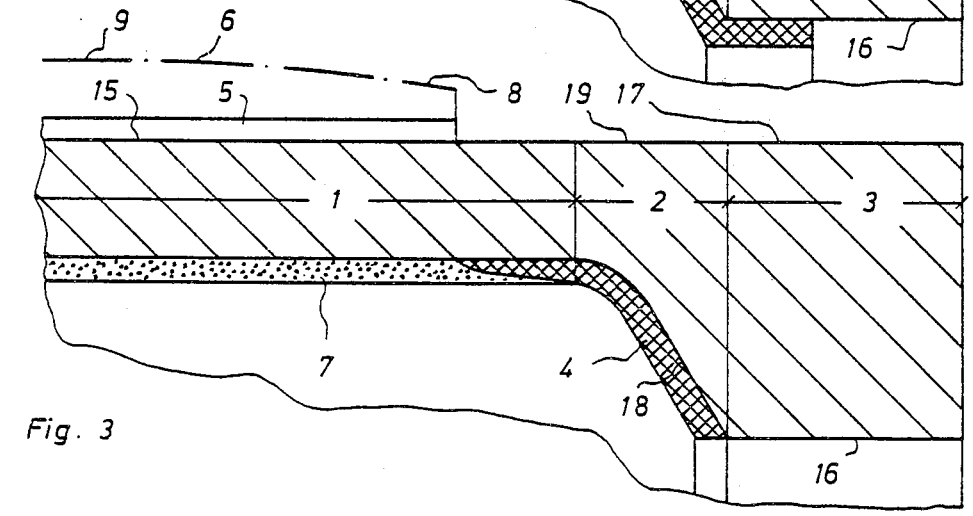
FIG. 3 is a partial, longitudinal section of an end of a specific embodiment of the invention depicting the paper terminating on the outer surface of a cylinder jacket center and illustrates an insulating layer tapering axially inwardly along the inner surfaces of the cylinder jacket center region.

FIGS. 1-3 may also be viewed as three successive stages of the drying process of paper 5 during the drying on a multiple cylinder machine. FIG. 1 shows the width of unshrunken paper 5 at the beginning of the drying process, FIG. 2 shows the partially shrunk width of paper 5 in the intermediate region of the drying process, and FIG. 3 shows the width of paper 5 at the end of the drying process terminating on outer surface 15 of cylinder jacket 1.

Substantial elimination of overdrying may be effected by varying the width of the insulation layer 4 during the drying process such that the variation follows the shrinkage of paper 5. However, satisfactory results are obtained when all drying cylinders have insulation layer 4 applied as depicted in FIG. 2. This results in curve 6 becoming generally a straight and horizontal line 9.

While there have been described above the principles of this invention in connection with a specific apparatus and method, it is to be clearly understood that this description is made only by way of example and not as a limitation to the scope of the invention.

What is claimed is:

1. A steam heating drying cylinder for machines for making paper comprising:

a cylindrical shell having inner surfaces thereon, said cylindrical shell comprising a center region of substantially uniform thickness having inner surfaces thereon, end flanges extending radially inwardly of said center region and having inner surfaces thereon, and transition regions being disposed between said center region and said end flanges, said transition regions having inner surfaces that taper radially outwardly from said end flanges toward said center region, and an insulation layer being disposed on said inner surfaces of said transition regions for providing substantially uniform drying along the width of the paper being made.

2. The cylinder of claim 1 wherein said insulation layer extends onto a portion of said inner surfaces of said end flanges.

3. The cylinder of claim 1 wherein said insulation layer extends onto a portion of said inner surfaces of said center region.

4. The cylinder of claim 1 wherein said insulation layer has a thickness of about 0.5 mm to about 5.0 mm.

5. The cylinder of claim 1 wherein said insulation layer is a pliable mat adheringly attached by an adhesive.

6. The cylinder of claim 1 wherein said insulation layer is a hardened material applied as a hardenable paste.

* * * * *